US007294041B1

(12) United States Patent
Lee et al.

(10) Patent No.: US 7,294,041 B1
(45) Date of Patent: Nov. 13, 2007

(54) MOVING HEAD FOR SEMICONDUCTOR WAFER POLISHING APPARATUS

(75) Inventors: Eun Sang Lee, Incheon (KR); Jong Goo Won, Incheon (KR); Jung Talk Lee, Incheon (KR)

(73) Assignee: Inha-Industry Partnership Institute, Incheon (KR)

( * ) Notice: Subject to any disclaimer, the term of this patent is extended or adjusted under 35 U.S.C. 154(b) by 67 days.

(21) Appl. No.: 11/532,134

(22) Filed: Sep. 15, 2006

(30) Foreign Application Priority Data

Aug. 31, 2006 (KR) ..... 10-2006-0083679

(51) Int. Cl.
*B24B 49/00* (2006.01)

(52) U.S. Cl. ..... 451/8; 451/10; 451/388

(58) Field of Classification Search ..... 451/5, 451/8, 10, 11, 19, 24, 276, 285, 288, 289, 451/388, 398

See application file for complete search history.

(56) References Cited

U.S. PATENT DOCUMENTS 5,069,002 A * 12/1991 Sandhu et al. ..... 451/1
5,865,665 A * 2/1999 Yueh ..... 451/5
5,916,009 A * 6/1999 Izumi et al. ..... 451/5
6,712,670 B2 * 3/2004 de la Llera et al. ..... 451/11

FOREIGN PATENT DOCUMENTS

KR 1997-705718 8/1997

* cited by examiner

*Primary Examiner*—Lee D. Wilson
*Assistant Examiner*—Anthony Ojini
(74) *Attorney, Agent, or Firm*—Adam K Sacharoff; Much Shelist

(57) ABSTRACT

Disclosed herein is a moving head for a semiconductor wafer polishing apparatus. The semiconductor wafer polishing apparatus has a table on which a polishing pad is formed, and the moving head mounted via a support unit to hold a wafer relative to a polishing surface of the table. In this case, the moving head includes a sensing means having a load cell and a piezoelectric sensor to measure pressing force and frictional force acting on the wafer provided in the moving head. The present invention relates to the polishing of a semiconductor wafer material from which an integrated circuit is made. That is, the present invention provides a moving head for semiconductor wafer polishing apparatuses, which detects vibrations transmitted to a wafer and outputs signals indicating frictional force and pressing force acting on the wafer, using a load cell and a piezoelectric sensor installed in the moving head so as to maintain optimum frictional force and pressing force relative to the surface of a polishing pad, thus realizing precise final polishing.

5 Claims, 3 Drawing Sheets

MOVING HEAD FOR SEMICONDUCTOR WAFER POLISHING APPARATUS

BACKGROUND OF THE INVENTION

1. Field of the Invention

The present invention relates generally to a moving head for semiconductor wafer polishing apparatuses and, more particularly, to the polishing of a semiconductor wafer material from which an integrated circuit is made. That is, the present invention relates to a moving head for semiconductor wafer polishing apparatuses, which detects vibrations transmitted to a wafer and outputs signals indicating frictional force and pressing force acting on the wafer, using a load cell and a piezoelectric sensor installed in the moving head so as to maintain optimum frictional force and pressing force relative to the surface of a polishing pad, thus realizing precise final polishing.

2. Description of the Related Art

Generally, since a wafer polishing process is a process for realizing final flatness and surface roughness, prior to a device assembly process, the wafer polishing process is very important. Because it is so important, a lot of research on wafer polishing process has been conducted by research workers in research laboratories. However, due to the special characteristics of wafers, the results of most of the research are not clear.

The final polishing process is conducted through the following method. That is, a wafer carried by a carrier is rotated on a polishing pad, so that the surface of the wafer is mechanically flattened. Simultaneously, slurry, which undergoes a chemical reaction, is supplied to the upper surface of the polishing pad, so that the wafer is chemically flattened.

Meanwhile, in order to achieve a higher removal rate in the final polishing process, the surface roughness of the polishing pad must be always kept constant. However, as the final polishing process is continuously performed, the surface roughness is reduced, and thus a polishing function is gradually lost. In order to prevent the loss of the polishing function, a device called a pad conditioner is used.

The pad conditioner is a device for optimizing the condition of the pad so that wafer polishing is normally conducted on the polishing pad. The pad conditioner functions to flatten the polishing pad and to prevent particles generated by a slurry solution or a polishing process from being deposited on the pad, thus preventing the pad from losing its function. Further, the pad conditioner helps the pad maintain constant surface roughness, in addition to evenly distributing the slurry solution.

However, when the pad conditioning operation is conducted, the pad conditioner is repeatedly used without checking the condition of the polishing pad using a sensor. Thus, it is impossible to know the condition of the pad.

FIG. 1 is a view showing a conventional chemical-mechanical polishing (CMP) apparatus. Referring to the drawing, the CMP apparatus includes a moving head 104. A wafer 100 is attached to the lower surface of the moving head 104 which is connected to a shaft 102. The moving head 104 is rotatably mounted to the upper portion of a main body (not shown). The moving head 104 is in close contact with the polishing pad 108 of a table 106, and is rotated while applying a predetermined pressure.

The polishing pad 108 is connected to a rotating shaft such that the polishing pad 108 is rotated by a drive means provided on the lower portion of the main body. The polishing pad 108 is coupled to a polishing retainer ring 110 to which the wafer 100, mounted to the lower surface of a platen of the moving head 104, is mounted.

Such a CMP apparatus is disclosed in Korean Patent Appln. No. 1997-705718, which is titled "Method of Determining Frictional Coefficient of Polishing Pad". The method is problematic in that dressing is required every time a polishing process is conducted without monitoring frictional force or pressing force, so that the efficiency of the process is low. In other words, the frictional force of the moving head in the CMP apparatus is detected at the exterior, and thus the detected result may be slightly inaccurate due to factors interfering with the detection.

Further, U.S. Pat. No. 5,916,009 has been proposed, and is titled "Apparatus for Applying and Urging Force to a Wafer". According to the cited document, a carrier includes a holder and a pressure-bearing member. A wafer is mounted to the lower surface of the carrier. A load cell and a spring plate are provided between the holder and the pressure bearing member, and are rotated by a rotating shaft. However, the conventional wafer polishing apparatus is problematic in that it is impossible to monitor frictional force and pressing force, which are important factors affecting surface roughness in the final wafer polishing process, in real time, and thus the efficiency of polishing the wafer is poor.

SUMMARY OF THE INVENTION

Accordingly, the present invention has been made keeping in mind the above problems occurring in the prior art, and the present invention relates to the polishing of a semiconductor wafer material from which an integrated circuit is made. That is, an object of the present invention is to provide a moving head for semiconductor wafer polishing apparatuses, which detects vibrations transmitted to a wafer and outputs signals indicating frictional force and pressing force acting on the wafer, using a load cell and a piezoelectric sensor installed in the moving head so as to maintain optimum frictional force and pressing force relative to the surface of a polishing pad, thus realizing precise final polishing.

In order to accomplish the above object, the present invention provides a moving head for a semiconductor wafer polishing apparatus having a table on which a polishing pad is formed, and the moving head mounted via a support unit to hold a wafer relative to a polishing surface of the table, wherein the moving head includes a sensing means having a load cell and a piezoelectric sensor to measure pressing force and frictional force acting on the wafer provided on the moving head.

Preferably, the moving head is connected to a roll which is interposed between the moving head and a branch rod of the support unit. The moving head measures frictional force using a signal detected by a flexible piezoelectric sensor mounted to the moving head. It is preferable that five or more load cells be mounted in order to detect all of the pressing force acting on the wafer. Further, according to the present invention, the piezoelectric sensor is preferably provided on the lower portion of a platen which is mounted to a post.

A plurality of load cells is installed between a frame connected to the piezoelectric sensor and the wafer installed inside a retainer ring provided around the bottom edge of the frame. The load cells are provided at the center of the moving head and four sides surrounding the center.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the preferred embodiment of the present invention will be described in detail with reference to the accompanying drawings.

Figure 1:
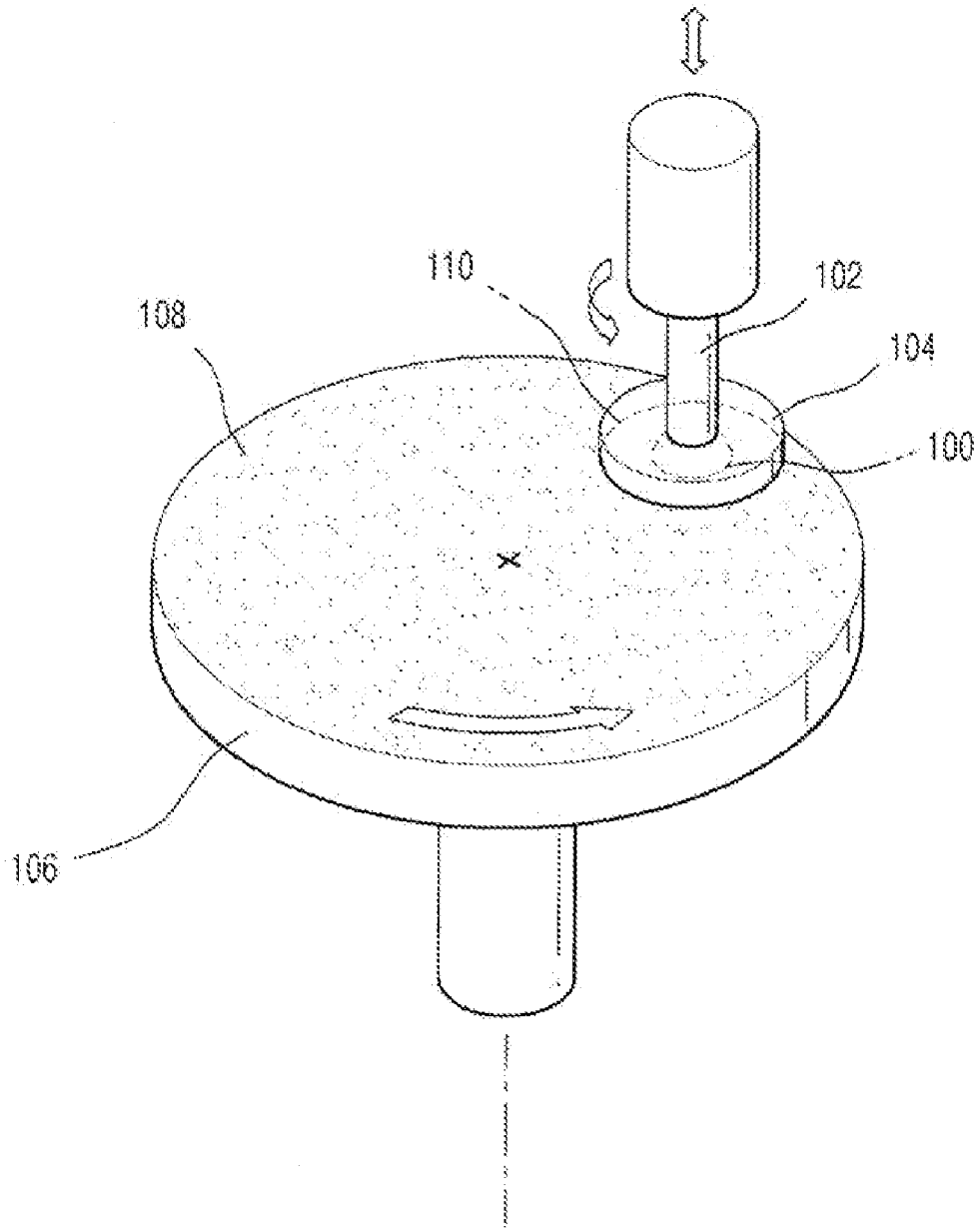
FIG. 1 PRIOR ART
FIG. 1 is a view showing a conventional CMP apparatus.
Figure 2:
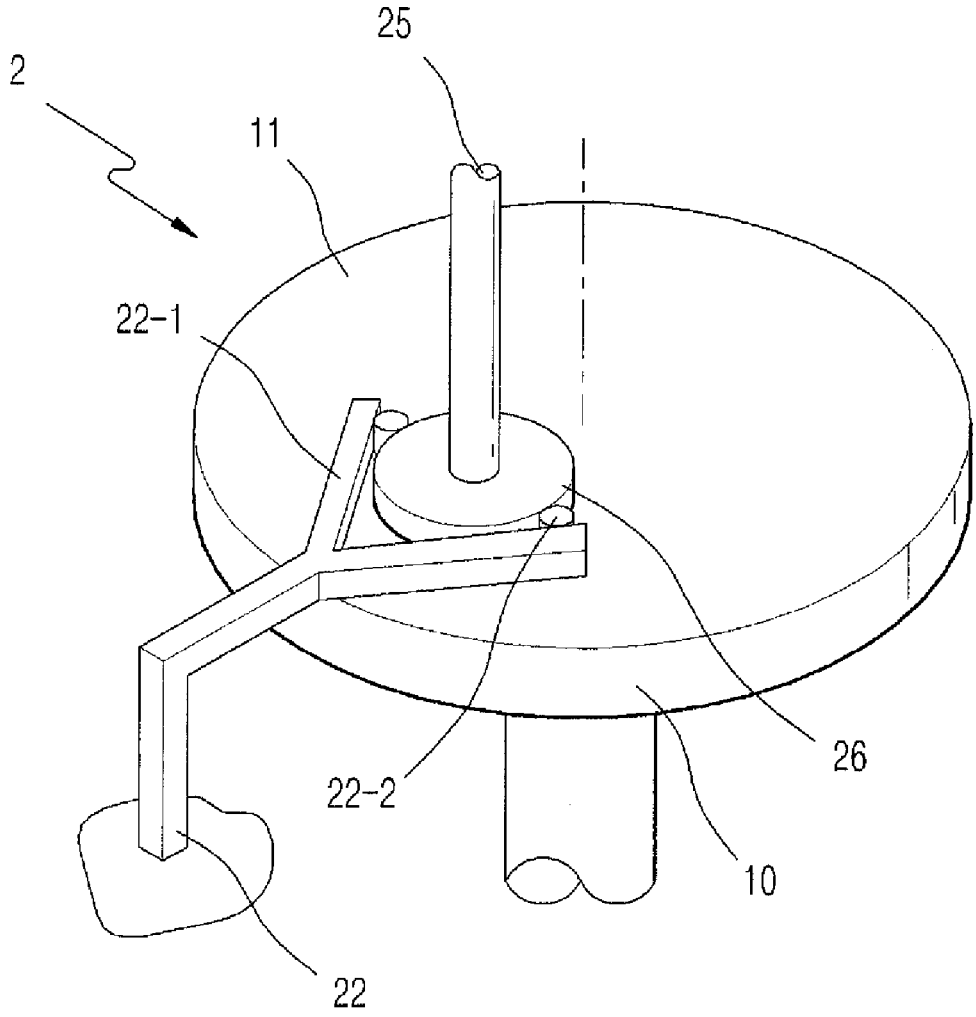
FIG. 2 is a view schematically showing a semiconductor wafer polishing apparatus equipped with a moving head, according to the present invention.
Figure 3:
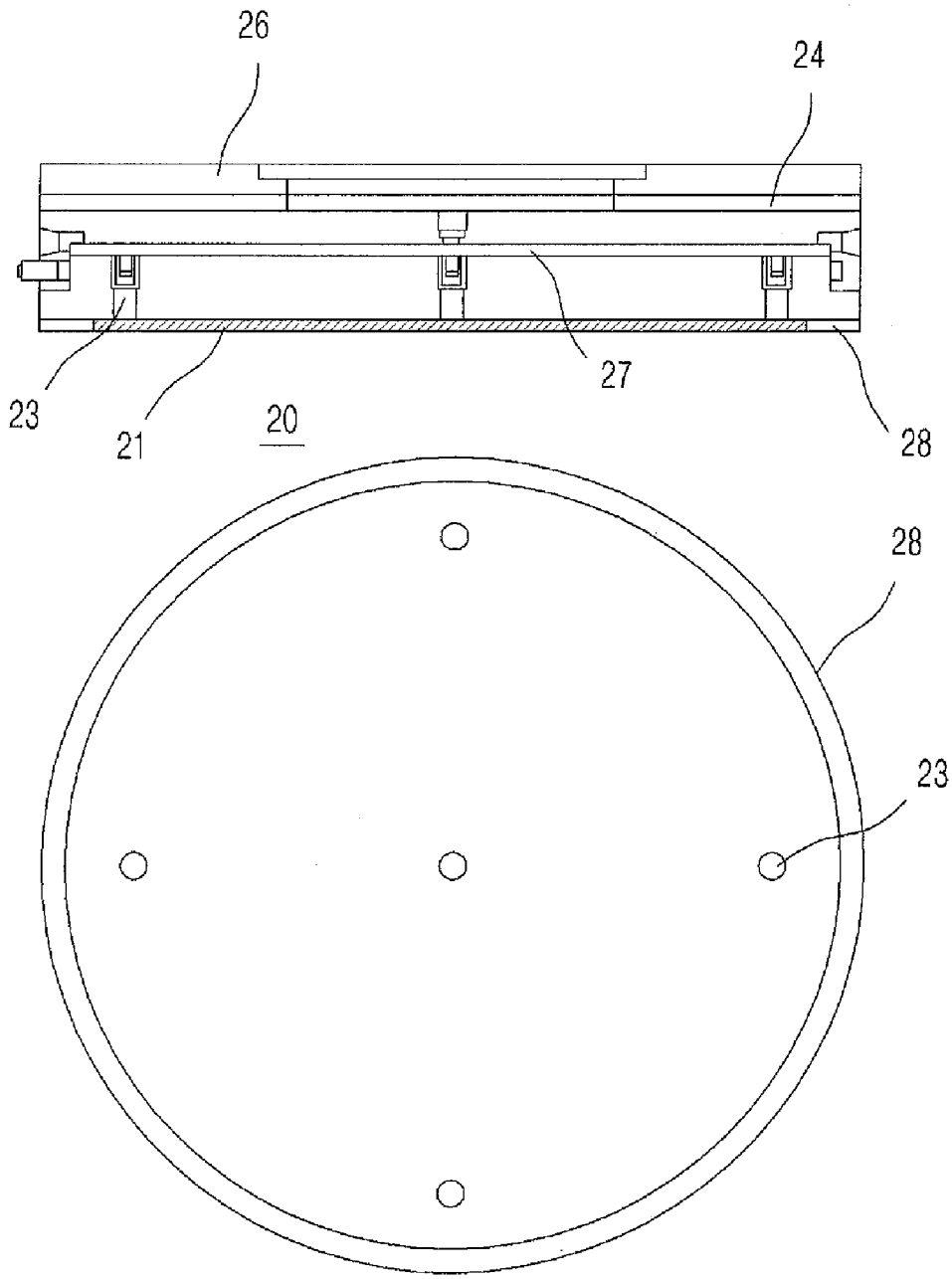
FIG. 3 is a side sectional view showing the moving head of FIG. 2.

FIG. 2 is a view schematically showing a semiconductor wafer polishing apparatus equipped with a moving head, according to the present invention, and FIG. 3 is a side sectional view showing the moving head of FIG. 2.

Referring to the drawings, a semiconductor wafer polishing apparatus 2 includes a table 10 and a moving head 20. A polishing pad 11 is formed on the table 10. The moving head 20 is mounted on the polishing pad 11, and brings a wafer 21 into close contact with the surface of the polishing pad 11 of the table 10 via a support unit 22.

A load cell 23 and a piezoelectric sensor 24, which are sensing means, are provided in the moving head 20, and measure pressing force and frictional force acting on the wafer 21 provided inside the moving head 20.

The moving head 20 is connected to branch rods 22-1 of the support unit 22 via rolls 22-2 which are interposed between the moving head 20 and the branch rods 22-1. The flexible piezoelectric sensor 24 is mounted to the moving head 20, thus measuring frictional force based on a detected signal.

Five or more load cells 23 are mounted to the moving head 20 to detect all of the pressing force acting on the wafer 21. The piezoelectric sensor 24 is mounted to the lower portion of a platen 26 which is installed to a post 25, thus detecting frictional force.

A plurality of load cells 23 is installed between the wafer 21 and a frame 27. The frame 27 is connected to the piezoelectric sensor 24. The wafer 21 is installed inside a retainer ring 28 which is provided around the bottom edge of the frame 27.

The load cells 23 are arranged at the center and four sides surrounding the center such that the load cells 23 are spaced apart from each other by a predetermined interval.

Each of the load cells 23 may have a load sensing range from 0 kg to 500 kg. The moving head 20 is used to measure pressing force acting on the wafer 21. The load cells 23 detect the entire pressing force acting on the wafer 21.

Further, the support unit 22 is installed to measure frictional force which is required in order to efficiently perform a wafer polishing process.

The piezoelectric sensor 24 measures frictional force using a signal which is generated when the moving head 20 is freely rotated by frictional force.

The present invention, constructed as described above, is operated as follows. That is, pressing force is detected by the flexible piezoelectric sensor 24 installed in the moving head 20.

Further, while the moving head 20 is rotated, the pressing force is detected via the rolls 22-2 mounted on the support unit 22.

The frictional coefficient U between the polishing pad 11 and the wafer 21 is calculated through the following Equation.

$$U=Fr/W_H \qquad \text{[Equation]}$$

In this case, Fr is the force measured by the flexible piezoelectric sensor 24 installed in the moving head 20, and $W_H$ is the weight of the moving head 20. The frictional coefficient does not depend on the increase or reduction in the weight of the head, and represents the surface roughness of the pad.

For example, when the weight of the moving head 20 is increased, the final force may be increased in proportion to the weight. However, the ratio of two values, that is, the ratio of force to weight, is kept constant. In this way, the frictional force can be measured.

A plurality of load cells 23 installed in the moving head 20 measures pressing force acting on the wafer 21. When pressing force acting on the wafer 21 is measured, template pieces are attached to the load cells 23 to prevent the wafer 21 from coming into direct contact with the load cells 23.

Further, the wafer 21 is installed inside the retainer ring 28 which is provided around the bottom edge of the moving head 20. Each of the load cells 23 may have a load sensing range from 0 kg to 500 kg.

After the moving head 20 is installed in this way, the moving head 20 is mounted to the semiconductor wafer polishing apparatus 2. Thus, the moving head 20 measures the pressing force acting on the wafer 21 due to the operation of the semiconductor wafer polishing apparatus. That is, the pressing force is measured by the five or more load cells 23 which are installed in the moving head 20. In this case, the load cells 23 detect all of the pressing force acting on the wafer 21.

Further, the flexible piezoelectric sensor 24 installed around the moving head 20 measures frictional force when the moving head 20 is freely rotated by the frictional force. That is, when the moving head 20 is freely rotated by the frictional force, the flexible piezoelectric sensor 24 generates a sensing signal varying in response to variation in frictional force, thus measuring the frictional force.

When the pressing force and the frictional force are measured by the load cells 23 and the flexible piezoelectric sensor 24, the support unit 22 is installed to efficiently measure the pressing force and the frictional force, thus enabling precise measurement. The support unit 22 continues a wafer polishing operation, thus improving precision when the frictional force is measured.

That is, the moving head 20 and the wafer 21 are supported by the support unit 22. Thus, the support unit 22 directly affects surface roughness in the wafer polishing operation, thus efficiently maintaining the wafer polishing operation.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

According to the present invention, a load cell and a piezoelectric sensor are installed in a moving head, so that sensing signals are directly transmitted to the moving head, and thus frictional force is precisely measured.

Further, a load cell and a piezoelectric sensor are directly installed in a moving head applied to a final wafer polishing apparatus, thus providing precise measurement data.

The signals indicating frictional force and pressing force can be detected by a load cell and a piezoelectric sensor which are directly installed in a moving head, thus affording more efficient measurement, compared to the conventional method of measuring at the exterior, therefore increasing wafer polishing efficiency.

Since pressing force can be changed using a support unit, more precise measurement is possible.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred.

What is claimed is:

1. A moving head for a semiconductor wafer polishing apparatus, in which the semiconductor wafer polishing apparatus has a table having a polishing pad formed thereon, and the moving head mounted via a support unit to hold a wafer relative to a polishing surface of the table, the moving head comprising:

sensing means having a load cell and a piezoelectric sensor to measure pressing force and frictional force acting on the wafer provided on the moving head, wherein the moving head is connected to a roll which is interposed between the moving head and a branch rod of the support unit.

2. The moving head as set forth in claim 1, wherein the load cell is installed between a frame and the wafer installed inside a retainer ring provided around a bottom edge of the frame.

3. A moving head for a semiconductor wafer polishing apparatus, in which the semiconductor wafer polishing apparatus has a table having a polishing pad formed thereon, and the moving head mounted via a support unit to hold a wafer relative to a polishing surface of the table, the moving head comprising:

sensing means having a load cell and a piezoelectric sensor to measure pressing force and frictional force acting on the wafer provided on the moving head; and a flexible piezoelectric sensor mounted to a lower portion of a platen to measure frictional force.

4. A moving head for a semiconductor wafer polishing apparatus, in which the semiconductor wafer polishing apparatus has a table having a polishing pad formed thereon, and the moving head mounted via a support unit to hold a wafer relative to a polishing surface of the table, the moving head comprising:

sensing means having a load cell and a piezoelectric sensor to measure pressing force and frictional force acting on the wafer provided on the moving head, and wherein the load cell comprises five or more load cells to detect all pressing force acting on the wafer.

5. A moving head for a semiconductor wafer polishing apparatus, in which the semiconductor wafer polishing apparatus has a table having a polishing pad formed thereon, and the moving head mounted via a support unit to hold a wafer relative to a polishing surface of the table, the moving head comprising:

sensing means having a load cell and a piezoelectric sensor to measure pressing force and frictional force acting on the wafer provided on the moving head, and wherein the load cells are provided at a center of the moving head and at predetermined positions around the center at regular intervals.

* * * * *